US012767277B2

(12) United States Patent
Ganzinga et al.

(10) Patent No.: US 12,767,277 B2
(45) Date of Patent: Oct. 20, 2026

(54) MOORING ASSEMBLY

(71) Applicant: BLUEWATER ENERGY SERVICES B.V., Hoofddorp (NL)

(72) Inventors: Willem Sievert Ganzinga, Beverwijk (NL); Hielke Brugts, Hoofddorp (NL); Peter Nicolaas van Sloten, Voorhout (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 882 days.

(21) Appl. No.: 18/103,875

(22) Filed: Jan. 31, 2023

(65) Prior Publication Data

US 2024/0253743 A1 Aug. 1, 2024

(51) Int. Cl.
*B63B 21/16* (2006.01)
*B63B 21/00* (2006.01)

(52) U.S. Cl.
CPC ..... *B63B 21/16* (2013.01); *B63B 2021/002* (2013.01)

(58) Field of Classification Search
CPC ..... B63B 21/16; B63B 2021/002; B63B 2021/001; B63B 21/50
See application file for complete search history.

(56) References Cited

U.S. PATENT DOCUMENTS

2011/0139054 A1 6/2011 Liu et al.
2014/0283727 A1* 9/2014 Liu ..... B63B 21/50 114/230.14
2023/0110646 A1* 4/2023 Duggal ..... B63B 21/00 114/230.2
2023/0150614 A1* 5/2023 Duggal ..... B63B 21/26 114/230.1
2023/0257074 A1* 8/2023 Yu ..... B63B 21/16 114/230.1

FOREIGN PATENT DOCUMENTS

NO 345396 B1 * 1/2021 ..... B63B 27/08
WO WO-03059728 A1 * 7/2003 ..... E02B 3/24

* cited by examiner

*Primary Examiner* — Anthony D Wiest
(74) *Attorney, Agent, or Firm* — Steven M. Koehler; Westman, Champlin & Koehler, P.A.

(57) ABSTRACT

A mooring assembly comprises a mooring base, a yoke, a ballast box and a pendulum which suspends from a vessel. The yoke has a mooring base connection part which is pivotally mounted to the base and a pendulum connection part which is spaced apart from the base connection part and pivotally mounted to the pendulum. The ballast box is mounted to one of the pendulum and the yoke such that it creates a restoring force when the vessel moves away from a neutral position relative to the base. The mooring assembly is provided with a de-coupling device for de-coupling at least the yoke and the ballast box together from the vessel. The ballast box is provided with a compartment for containing a liquid and the mooring assembly is provided with a fluid transport system for removing a liquid and introducing a gas into the compartment or vice versa.

20 Claims, 2 Drawing Sheets

MOORING ASSEMBLY

BACKGROUND

The discussion below is merely provided for general background information and is not intended to be used as an aid in determining the scope of the claimed subject matter.

The present invention relates to a mooring assembly, comprising a floating vessel, a mooring base, a yoke, a ballast box and a pendulum which suspends from the floating vessel, wherein the yoke has a mooring base connection part which is pivotally mounted to the mooring base and a pendulum connection part which is located at a distance from the mooring base connection part and pivotally mounted to the pendulum, wherein the ballast box is mounted to one of the pendulum and the yoke such that it creates a restoring force when the floating vessel moves away from a neutral position relative to the mooring base, wherein the mooring assembly is provided with a de-coupling device for de-coupling at least the yoke and the ballast box together from the floating vessel.

In a known mooring assembly, the floating vessel can be disconnected from the mooring base in the event of expected severe weather conditions such as an approaching hurricane. More specifically, the pendulum, the yoke and the ballast box together can be de-coupled from the floating vessel by disconnecting an upper end of the pendulum from the floating vessel such that the pendulum, the yoke and the ballast box can be parked on the seabed. A disadvantage of the known mooring assembly is that upon de-coupling, the load of the pendulum on the floating vessel may be quite high due to the weight of the ballast box and motions of the floating vessel which makes de-coupling difficult. Therefore, de-coupling is more feasible when the weather conditions are still relatively calm.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the present invention aims to provide an improved mooring assembly which allows a safe de-coupling of the floating vessel from the mooring base.

For this purpose, the ballast box is provided with a compartment for containing a liquid and the mooring assembly is provided with a fluid transport system for removing a liquid from the compartment and introducing a gas into the compartment or vice versa.

In the mooring assembly, the compartment may be filled with a liquid in case of normal operating conditions, i.e. when the floating vessel and the mooring base are coupled to each other and the pendulum, the yoke and the ballast box cause a restoring force when the floating vessel moves away from a neutral position relative to the mooring base, whereas the weight of the ballast box can be reduced by replacing the liquid by gas prior to de-coupling the floating vessel from the mooring base through the de-coupling device. Due to the resulting weight decrease of the ballast box the load on the floating vessel upon de-coupling is relatively low. This means that safe de-coupling is still possible at rough sea conditions such that the moment of de-coupling can be relatively short before severe weather conditions arrive.

The fluid transport system may comprise a compressed gas source which is fluidly connectable with the compartment. This provides the opportunity to remove a liquid from the compartment and simultaneously introduce gas into the compartment. The compressed gas source may be fluidly connectable with the compartment through a valve. The valve may be operated remotely, for example. The compressed gas source may be located at the floating vessel and a compressed air line may extend between the compressed gas source and the compartment.

The compressed gas source may comprise a compressed gas bottle which is mounted to the exterior of the ballast box or the yoke. This configuration does not require long compressed air lines from the floating vessel to the ballast box.

Alternatively, the fluid transport system may be provided with a pump for replacing a liquid by a gas in the compartment or vice versa.

The mooring assembly may be provided with a winch at the floating vessel for bearing at least the ballast box and the yoke together. Before de-coupling at least the yoke and the ballast box together from the vessel, the winch may be operated to lower them towards the seabed in a controlled manner. The winch may be braked in order to slow down the sinking movement. Since the weight of the ballast box can be reduced before lowering the yoke and the ballast box together, relatively low braking power is required, which provides the opportunity to apply a winch which has minimized power.

The winch may bear an upper end of the pendulum. In this case the winch bears the pendulum including the yoke and the ballast box. Hence, the pendulum suspends from the floating vessel through the winch, whereas the winch can lower the pendulum, the yoke and the ballast box together to the seabed.

The de-coupling device may be located between the winch and the pendulum, for example at the upper end of the pendulum. This means that after removing the liquid from the compartment the winch can lower the pendulum, the yoke and the ballast box to the seabed and after arriving on the seabed the winch can be de-coupled from the pendulum through the de-coupling device.

In an alternative embodiment the pendulum may suspend directly from the floating vessel through the de-coupling device, i.e. without a winch. In that case, the floating vessel can be de-coupled quickly from the mooring base by activating the de-coupling device such that the yoke, the ballast box and the pendulum sink to the seabed by gravity without being controlled by a winch.

The mooring assembly may be provided with a hawser which is detachably mounted to at least one of the floating vessel, for example through quick release hooks, and the mooring base. This provides the opportunity to temporarily attach the floating vessel to the mooring base during a period of moving at least the ballast box and the yoke together to the seabed before de-coupling them from the floating vessel. After de-coupling, the hawser may be detached from at least one of the floating vessel and the mooring base such that the floating vessel can sail away from the mooring base.

Preferably, the hawser is flexible, for example made of nylon. This allows movements of the floating vessel with respect to the mooring base to a certain degree, without the risk of moving away from the mooring base too far and disturbing the de-coupling process and without causing high peak loads.

In a particular embodiment at least the ballast box is submerged when it is coupled to the floating vessel. In this case the ballast box is submerged permanently, both in a connected and disconnected condition of the floating vessel and the mooring base. Replacing the liquid in the compartment by gas causes increase of buoyancy, which lowers the load on the floating vessel when the floating vessel should be disconnected from the mooring base. It is noted that the yoke and at least a part of the pendulum may also be submerged permanently.

Preferably, the liquid is water and the gas is air, since this is available abundantly at offshore locations. Particularly, when at least the ballast box is submerged permanently, it is easy to refill the compartment with water and remove the air when the disconnected floating vessel should be coupled to the mooring base again.

The yoke and the ballast box may be fixed to each other. In this case the pendulum may be pivotally coupled to the ballast box. The ballast box may form a part of the yoke.

The pendulum may comprise a chain.

The ballast box may have a cylindrical shape.

In a particular embodiment the ballast box is elongate and has a central weight including a density of more than 2 kg/dm3, whereas the compartment comprises sub-compartments at either side of the central weight in longitudinal direction of the ballast box.

BRIEF DESCRIPTION OF THE DRAWINGS

Aspects of the invention will hereafter be elucidated with reference to schematic drawings showing an embodiment of the invention by way of example.

DETAILED DESCRIPTION OF THE ILLUSTRATIVE EMBODIMENT

Figure 1:
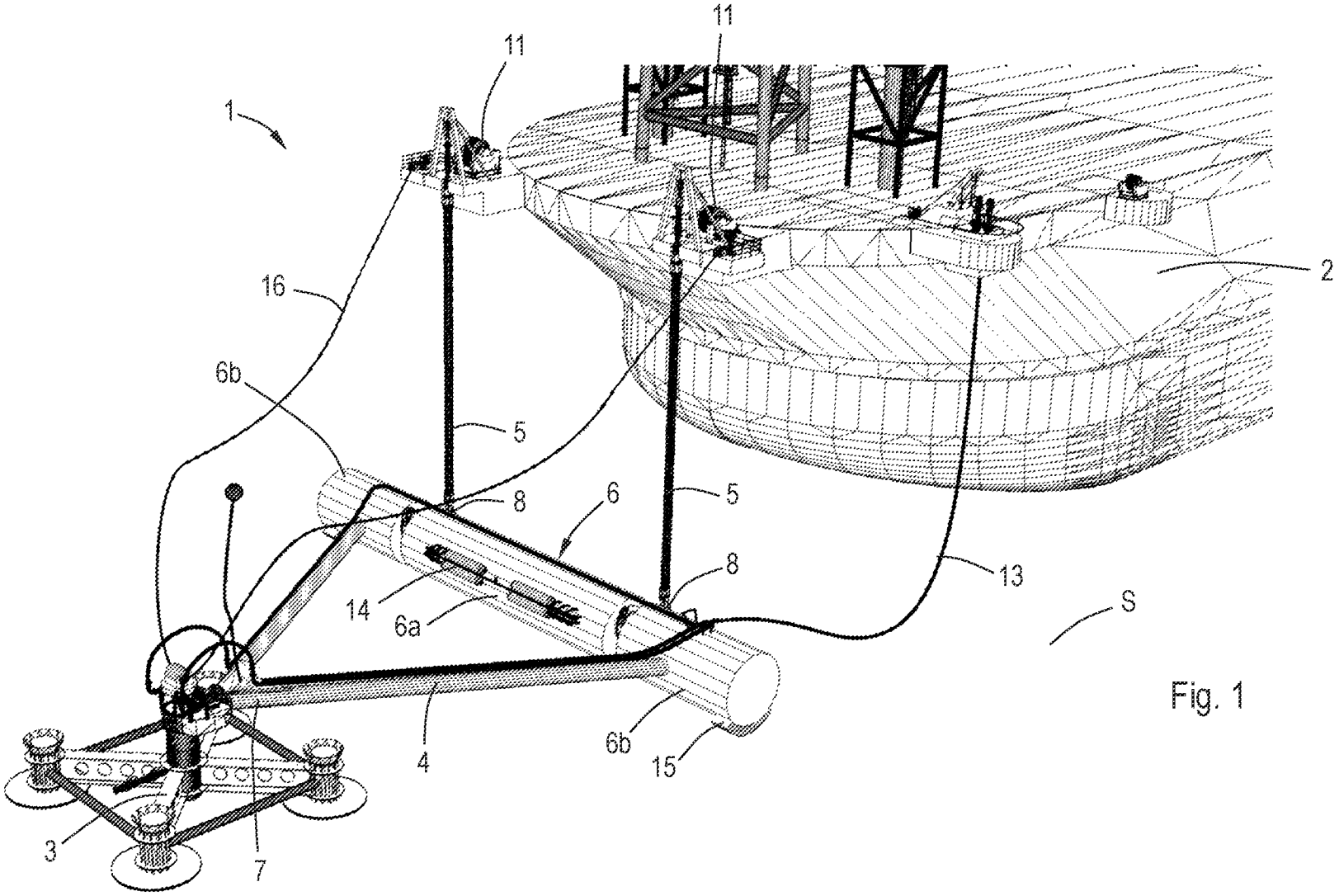
FIG. 1 is a perspective view of an embodiment of a mooring assembly.
Figure 2:
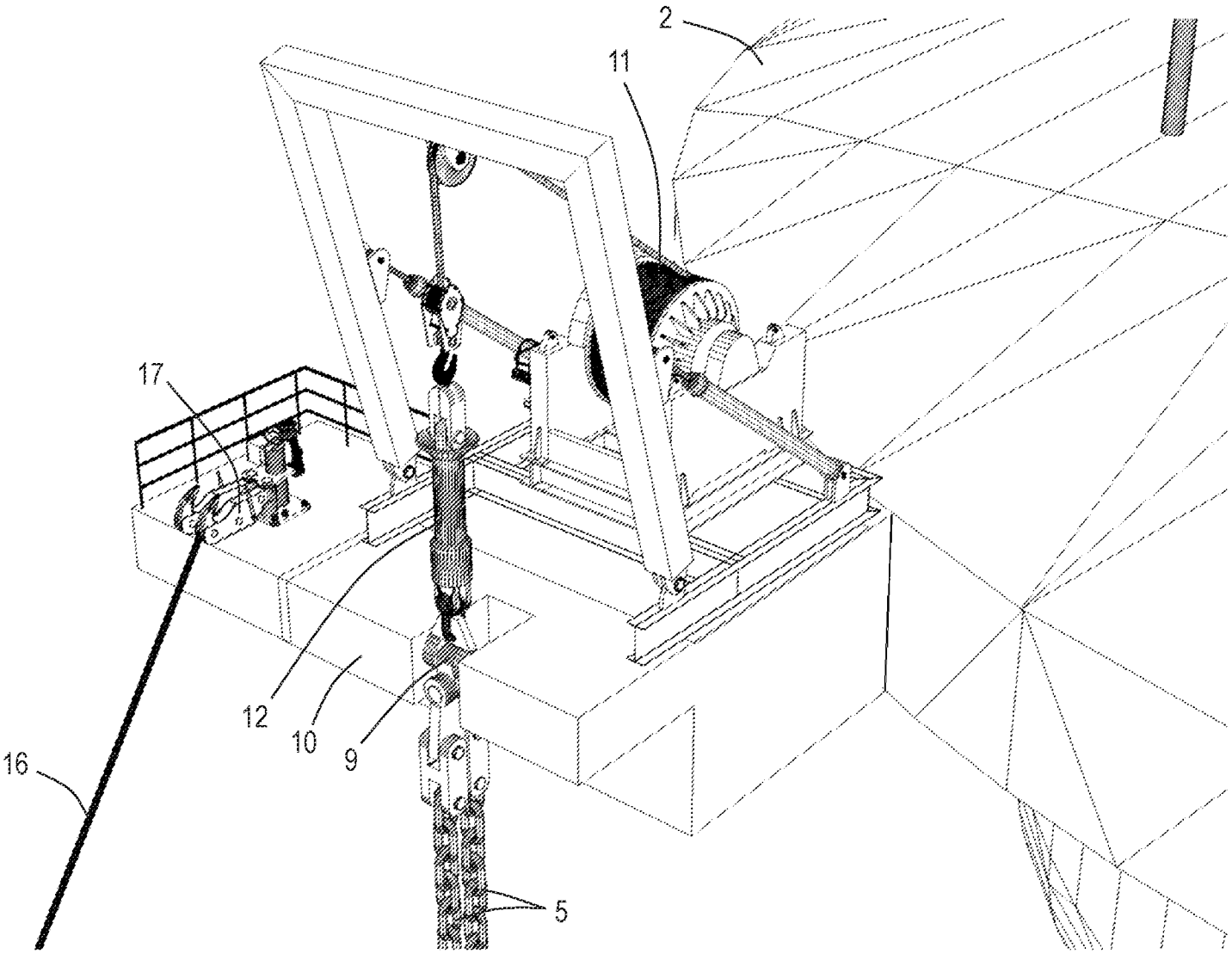
FIG. 2 is a similar view as FIG. 1, showing an enlarged part thereof in more detail.

FIGS. 1 and 2 show an embodiment of a mooring assembly 1, which may also be called a soft yoke mooring system (SYMS). The mooring assembly 1 may be used in relatively shallow waters, having a depth of 20 m, for example. The mooring assembly 1 comprises a ship 2, a submerged mooring base 3 which is anchored to the seabed S, a submerged yoke 4, a pendulum in the form of two pairs of chains 5 which suspend from the ship 2 and a ballast box 6. The ship 2 may be a Floating Liquified Natural Gas (FLNG) vessel, for example.

In the embodiment as shown the ballast box 6 is part of the yoke 4. The yoke 4 has a triangular shape, of which the ballast box 6 forms a base. The yoke 4 has a mooring base connection part 7 which is mounted to the mooring base 3 through a joint that allows the yoke 4 to move in yaw, pitch and roll in response to such motions of the ship 2 with respect to the mooring base 3. The joint allows weather-vaning of the ship 2.

At a distance from the mooring base connection part 7, in this case on top of the ballast box 6, the yoke 4 is provided with pendulum connection parts 8 which are pivotally mounted to the respective pairs of chains 5. Upper ends of each pair of chains 5 are pivotally mounted to a chain support 9 which in turn is supported by a holder 10 of the ship 2, see FIG. 2. In the situation as shown in FIG. 2, the chain supports 9 are connected to cables of respective winches 11 on the ship 2 such that the winches 11 can lift the chain supports 9 from the holders 10. Between each chain support 9 and the cable of the corresponding winch 11 a controllable de-coupling device 12 is mounted. The chain supports 9 are separated from the cables of the respective winches 11 upon activating the de-coupling devices 12. FIG. 2 shows a situation in which the cable of the winch 11, the de-coupling device 12 and the chain support 10 are mounted to each other, but it is also possible that under normal operating conditions the de-coupling device 12 is not linked to the cable of the winch 11 and/or the chain support 10, since the holder 10 bears the chain support 9.

Under normal operating conditions, i.e. when the pairs of chains 5 are coupled to the ship 2 through the chain supports 9, the chains 5 and the yoke 4 including the ballast box 6 create a restoring force on the ship 2 when it moves away from a neutral position relative to the mooring base 3. If severe weather conditions are expected, such as an approaching hurricane, the cable of each winch 11, the corresponding de-coupling device 12 and the corresponding chain support 9 can be mounted to each other, if this is not the case yet. Then, the winches 11 can slightly lift the chain supports 9 such that they are freed from the holders 10, after which the winches 11 can lower the yoke 4 including the ballast box 6 and the chains 5 to the seabed S. Due to the heavy weight of the ballast box 6, the winches 11 may allow the chains 5 and the yoke 4 including the ballast box 6 to sink by gravity to the seabed S, whereas they are braked to slow down the sinking movement. After the chains 5 and the yoke 4 including the ballast box 6 have arrived on the seabed S the ship 2 can be de-coupled from the chains 5 by activating the controllable de-coupling devices 12. This provides the opportunity to move the ship 2 away from the mooring base 3 temporarily until the weather conditions have been improved.

The ship 2 can be re-connected to the mooring base 3 again through picking-up the chains 5, lifting the chains 5 and the yoke 4 including the ballast box 6 by the winches 11 and coupling the chain supports 9 to the respective holders 10. Upper end portions of the chains 5 may be provided with respective buoyancies which facilitate to pick-up the chains 5 after the ship 2 should be re-connected to the mooring base 3.

The mooring assembly 1 has flexible fluid lines 13 for transporting fluid between a submarine pipeline at the mooring base 3 and the ship 2. The fluid lines 13 are releasably mounted to the ship 2 so as to de-couple them from the ship 2 in case of disconnecting the ship 2 from the mooring base 3.

The ballast box 6 is elongate and has a cylindrical shape. It has a central weight **6*a* including a density which is significantly higher than the density of water, for example higher than 2 kg/dm3, and two compartments 6*b* at either side of the central weight 6*a*. The compartments 6*b* contain water when the ship 2 is connected to the mooring base 4**, i.e. under normal operating conditions.

FIG. 1 shows that at the outer side of the ballast box 6 compressed air bottles 14 are provided. The compressed air bottles 14 can communicate with the compartments **6*b* via compressed air lines which are provided with controllable air valves (not shown). Each of the compartments 6*b* has an outlet for discharging water from the compartments 6*b*. Upon opening the air valves compressed air flows from the compressed air bottles 14 to the compartments 6*b* and forces the water to flow from the compartments 6*b* through the respective outlets. As a result, water is removed from the compartments 6*b* and air is introduced into the compartments 6*b*. It is noted that the outlets may be permanently open or closable by respective outlet valves. In the latter case the outlet valves may be opened at the same time as the air valves when water should be removed from the compartments 6***b*.

In an alternative embodiment the air bottles 14 may be omitted or only used as a back-up system, whereas a compressed air source is located at the ship 2 and compressed air is supplied to the compartments 6*b* via tubes from the ship 2. Alternatively, a small service vessel (not shown) may be coupled to the mooring base 3 and supply compressed air via tubes at the mooring base 3 and the yoke 4 to the compartments 6*b*.

Replacing water by air in the compartments 6*b* leads to increased buoyancy or smaller weight of the ballast box 6, although a resultant downward force on the ballast box 6 due to the central weight 6*a* may remain. The increase of buoyancy means that tensions in the chains 5 are decreased, which minimizes required lifting power when lifting the chain supports 9 from the holders 10 and minimizes required braking power of the winches 11 in the event that the yoke 4 should be allowed to sink.

FIG. 1 shows that the ballast box 6 is provided with flexible fenders 15 at its lower side. The fenders 15 reduce the impact load upon parking the yoke 4 onto the seabed S.

When the yoke 4 including the ballast box 6 and the chains 5 have arrived on the seabed S, the compartments 6*b* may be filled again with water in order to create a stable condition during severe weather conditions.

The mooring assembly 1 is provided with a flexible hawser 16 which is detachably mounted to the ship 2 through quick release hooks 17 and to the mooring base 3. The hawser 16 may be made of nylon in order to provide resiliency or flexibility so as to minimize peak loads on the mooring base 3 and the ship 2. The function of the hawser 16 is to keep the ship 2 in place during emptying the compartments 6*b*, lowering the chains 5 and de-coupling the chains 5 from the winches 11. The hawser 16 can be detached from the ship 2 by means of the quick release hooks 17 and/or the mooring base 3 before the ship 2 starts to move astern in order to sail away from the mooring base 2. During moving astern or earlier or later the fluid lines 13 may be disconnected from the ship 2, as well.

It is also advantageous to use the hawser 16 for re-connecting the ship 2 and the mooring base 3 to each other before coupling the chains 5 to the ship 2 when the ship 2 has returned to the mooring base 2 after the severe weather conditions have passed. The flexible hawser 16 creates a stable situation in which no or minimized mooring loads will act on the chains 5 and the winches 11 when the yoke 4 and the ballast box 6 including the emptied compartments 6*b* are lifted and the chain supports 9 are mounted to the holders 10.

Re-connection of the ship 2 to the mooring base 3 may be performed by first paying-out the winches 11, picking-up the chains 5, connecting the chain supports 9 to the cables of the winches 11 through the de-coupling devices 12 and lifting the chains 5 and the yoke 4 including the ballast box 6 by means of the winches 11. If the compartments 6*b* contain water, they can be emptied first by introducing compressed air, for example through tubes from a compressed air source on the ship 2 or from a compressed air source on a service vessel via tubes at the mooring base 3 and the yoke 4 as described hereinbefore. This means that the required lifting power of the winches 11 may be relatively low. After the chain supports 9 are mounted to the holders 10 the compartments 6*b* can be filled with water, for example by opening the outlets of the compartments 6*b*.

It is also possible that the compartments 6*b* are so large that after emptying them the yoke 4 starts to float so as to facilitate re-connection of the chains 5 to the ship 2.

A floating ballast box 6 is also advantageous in the event that the chains 5 must be coupled to the ship 2 but the yoke 4 is still not aligned with the ship 2. In that case a tug boat or a service vessel can rotate the floating yoke 4 about the mooring base 3 until the yoke 4 and the ship 2 are aligned.

Furthermore, a floating ballast box 6 provides the opportunity to perform maintenance on the ballast box 6, the yoke 4, the chains 5 and parts thereof, such as pendulum joints, valves, air lines, etc in a simple manner. In that case, it is not necessary to deploy divers, which is advantageous in terms of safety.

In an alternative embodiment (not shown) the two pairs of chains 5 are mounted to the ship 2 through the controllable de-coupling devices 12 without being coupled to the winches 11. For example, the de-coupling devices 12 are mounted between the chain supports 9 and the respective pairs of chains 5 such that after activating the de-coupling devices 12, the chain supports 9 and one part of each de-coupling device 12 remains at the respective holders 10 and one part of each de-coupling device 12 remains at the sinking chains 5. Before activating the de-coupling devices 12 the compartments 6*b* may be emptied. The lowered weight of the ballast box 6 may cause a relatively slow sinking movement. Such an embodiment may be applied if a quick release is desired, i.e. without slowly sinking the yoke 4 including the ballast box 6 by means of the winches 11.

The invention is not limited to the embodiment shown in the drawings and described hereinbefore, which may be varied in different manners within the scope of the claims and the technical equivalents. For example, the compressed air bottles or alternative compressed air source may be replaced by or include an alternative fluid transport system for removing water from the compartments and introducing air into the compartments or vice versa, for example a pump.

The invention claimed is:

1. A mooring assembly, comprising a floating vessel, a mooring base, a yoke, a ballast box and a pendulum which suspends from the floating vessel, wherein the yoke has a mooring base connection part which is pivotally mounted to the mooring base and a pendulum connection part which is located at a distance from the mooring base connection part and pivotally mounted to the pendulum, wherein the ballast box is mounted to one of the pendulum and the yoke such that it creates a restoring force when the floating vessel moves away from a neutral position relative to the mooring base, wherein the mooring assembly is provided with a de-coupling device configured to decouple at least the yoke and the ballast box together from the floating vessel, wherein the ballast box is provided with a compartment for containing a liquid and the mooring assembly is provided with a fluid transport system for removing a liquid from the compartment and introducing a gas into the compartment or vice versa and wherein the mooring assembly is provided with a flexible hawser configured to form a direct connection between the mounting base and the floating vessel, the hawser being detachably mounted to at least one of the floating vessel and the mooring base.

2. The mooring assembly according to claim 1, wherein the fluid transport system comprises a compressed gas source which is fluidly connectable with the compartment.

3. The mooring assembly according to claim 2, wherein the compressed gas source comprises a compressed gas bottle which is mounted to the exterior of the ballast box or the yoke.

4. The mooring assembly according to claim 1, wherein the mooring assembly is provided with a winch at the floating vessel for bearing at least the ballast box and the yoke together.

5. The mooring assembly according to claim 4, wherein the winch bears an upper end of the pendulum.

6. The mooring assembly according to claim 5, wherein the de-coupling device is located between the winch and the pendulum.

7. The mooring assembly according to claim 1, wherein at least the ballast box is submerged when it is coupled to the floating vessel.

8. The mooring assembly according to claim 1, wherein the liquid is water and the gas is air.

9. The mooring assembly according to claim 1, wherein the yoke and the ballast box are fixed to each other.

10. The mooring assembly according to claim 1, wherein the pendulum comprises a chain.

11. The mooring assembly according to claim 1, wherein the ballast box has a cylindrical shape.

12. The mooring assembly according to claim 1, wherein the ballast box is elongate and has a central weight including a density of more than 2 kg/dm3, whereas the compartment comprises sub-compartments at either side of the central weight in longitudinal direction of the ballast box.

13. The mooring assembly according to claim 1, wherein a releasable hook is configured to detach the hawser from the floating vessel or the mooring base.

14. A mooring assembly, comprising a mooring base, a yoke, a ballast box and a pendulum configured to suspend from a floating vessel, wherein the yoke has a mooring base connection part which is pivotally mounted to the mooring base and a pendulum connection part which is located at a distance from the mooring base connection part and pivotally mounted to the pendulum, wherein the ballast box is mounted to one of the pendulum and the yoke such that it creates a restoring force when the floating vessel moves away from a neutral position relative to the mooring base, wherein the mooring assembly is provided with a de-coupling device configured to decouple at least the yoke and the ballast box together from the floating vessel, wherein the ballast box is provided with a compartment for containing a liquid and the mooring assembly is provided with a fluid transport system for removing a liquid from the compartment and introducing a gas into the compartment or vice versa and wherein the mooring assembly is provided with a flexible hawser configured to connect the floating vessel at a first end directly to the mounting base at a second end and bear mooring loads separate from any bearing loads through the yoke.

15. The mooring assembly according to claim 14, wherein the fluid transport system comprises a compressed gas source which is fluidly connectable with the compartment.

16. The mooring assembly according to claim 15, wherein the compressed gas source comprises a compressed gas bottle which is mounted to the exterior of the ballast box or the yoke.

17. The mooring assembly according to claim 14, wherein the hawser is detachably mounted to at least one of the floating vessel and the mooring base.

18. The mooring assembly according to claim 14, wherein the liquid is water and the gas is air.

19. The mooring assembly according to claim 14, wherein the ballast box is elongate and has a central weight including a density of more than 2 kg/dm3, whereas the compartment comprises sub-compartments at either side of the central weight in longitudinal direction of the ballast box.

20. The mooring assembly according to claim 14, wherein a releasable hook is configured to detach the hawser from at least one of the floating vessel and the mooring base.

* * * * *